United States Patent [19]

Lefevre et al.

[11] Patent Number: 4,847,905

[45] Date of Patent: Jul. 11, 1989

[54] METHOD OF ENCODING SPEECH SIGNALS USING A MULTIPULSE EXCITATION SIGNAL HAVING AMPLITUDE-CORRECTED PULSES

[75] Inventors: Jean-Paul Lefevre, Elancourt; Olivier Passien, Paris, both of France

[73] Assignee: Alcatel, France

[21] Appl. No.: 843,487

[22] Filed: Mar. 24, 1986

[30] Foreign Application Priority Data

Mar. 22, 1985 [FR] France ..... 85 04304

[51] Int. Cl.[4] ..... G10L 5/00

[52] U.S. Cl. ..... 381/36; 381/51

[58] Field of Search ..... 375/26; 381/36, 38, 381/39, 47, 50, 51; 364/513.5

[56] References Cited

U.S. PATENT DOCUMENTS

| | | | |
|---|---|---|---|
| 4,133,976 | 1/1979 | Atal et al. | 375/31 |
| 4,472,832 | 9/1984 | Atac et al. | 381/40 |
| 4,720,861 | 1/1988 | Bertrand | 381/36 |

OTHER PUBLICATIONS

ICASSP 84 Proceedings Mar. 19–21, 1984, San Diego, Calif.; IEEE Acoustics, Speech and Signal Processing Society, vol. 1, pp. 10.1.1–10.1.4, New York, U.S.; M. Berouti et al., "Efficient Computation and Encoding of Multipulse Excitation for LPC".

The Journal of the Acoustical Society of America, vol. 74, Supplement 1, 1983, p. S51, No. 2:41 (BB9), NY, U.S.; S. Singhal: "Optimizing Pulse Amplitudes in Multipulse Excitation".

*Primary Examiner*—Gary V. Harkcom
*Assistant Examiner*—Lawrence E. Anderson
*Attorney, Agent, or Firm*—Sughrue, Mion, Zinn, Macpeak & Seas

[57] ABSTRACT

In a digital speech encoding system wherein the transmitter substitutes for the original speech signal to be encoded (1) certain parameters supplied by an analysis circuit defining, within successive time frames, the characteristics of a synthesis filter modeling the vocal tract and located at a receiver connected to the transmitter via a low-bit-rate data link, and (2) a multipulse excitation signal intended for said synthesis filter and supplied by a pulse generating circuit which determines the pulse position and amplitudes by successive approximation minimizing the mean squared error between the original speech signal and the synthetic speech signal obtained from the filter, the pulse generating circuit adds to the amplitude of each of the pulses, at the end of the approximation routine, a corrective term that is a function of the value of the partial derivative of the mean squared error taken relative to the amplitude of the pulse under consideration, taken as an independent variable.

1 Claim, 2 Drawing Sheets

METHOD OF ENCODING SPEECH SIGNALS USING A MULTIPULSE EXCITATION SIGNAL HAVING AMPLITUDE-CORRECTED PULSES

BACKGROUND OF THE INVENTION

This invention relates to low-bit-rate digital encoding procedures used for vocoder speech inputs, which do not reproduce the original form of the speech signal, but rather certain parameters enabling the excitation signal and the characteristics of a filter producing a synthetic speech signal audibly resembling the original speech input to be defined over successive sampling instants or time frames. Specifically, it concerns a multipulse method of generating the filter excitation signal.

The filter models the vocal tract, which is assumed to be invariant over short time spans of the order of 20 ms. It reproduces the spectrum of short term frequencies of the speech signal, and especially the latter's maxima or formants, which are more readily perceived by the human ear than its minima. This filter can be designed using various analog or digital means, to provide coding by channels, formants or linear prediction.

The excitation signal necessary to the vocal tract modeling filter, or synthesis filter, to synthesize a speech signal, must simulate the vocal excitation signal. The oldest known way of developing this signal consists in using two switched sources:

a source of periodic pulses at the frequency of the fundamental of the original speech signal (pitch), used for voiced sounds (vowels)

and a noise source, used for unvoiced sounds (fricatives).

This mode of signal generation raises the problem of effectively distinguishing between voiced and unvoiced sounds. It finally yields an excitation signal bearing only a loose relation with the vocal excitation signal, which produces via the synthesis filter a synthetic speech signal of low fidelity, that is sometimes poorly intelligible.

There is another known way of generating the excitation signal for the synthesis filter, taught particularly in U.S. Pat. No. 4,472,832, which gives this signal a waveform more like that of the vocal excitation signal in order to obtain a synthetic speech signal of greater fidelity. This method consists in generating, for the purpose of exciting the vocal tract modeling synthesis filter, a signal made up of pulses whose positions and amplitudes in each time frame are adjusted so as to minimize therein the differences between the synthesized speech signal and the signal of the speech to be encoded. Such minimizing is carried out according to the criterion of mean-squared error minimization within the time frame under consideration with a so-called perceptual weighting of the error taking into account the human ear's lesser sensitivity to distortions in the format regions of the speech frequency spectrum having a relatively high energy concentration.

Minimization based on the mean-squared error must be obtained with a minimum number of pulses to limit as much as possible the bit rate required for transmitting the coded speech. Lacking a direct solution to this problem, it is necessary to choose discrete locations where it is possible to place pulses and to proceed by successive approximation, so defining at each stage the weighted mean-squared error resulting from the pulsed signal adopted for the previous stage, to which is added a new pulse of unknown amplitude and position, determining at this time the possible position of the new pulse and the value of amplitude which cancels the partial derivative of said weighted mean-squared error with respect to said amplitude, taken as an independent variable, and then choosing the position of the pulse for which said weighted mean-squared error is smallest and adopting as pulsed signal for the given stage that signal used for the previous stage plus thus defined.

The successive approximation process is stopped after a certain number of iterations determined according to the available computing capacities and the encoding bit rate.

The disadvantage of this approach is that it accumulates the errors and thus causes a degrading of the signal-to-noise ratio of the synthetic speech signal that is particularly evident when synthesizing high-pitched voices.

To obviate this disadvantage, it has been proposed to recalculate the optimal amplitudes of all the pulses (reoptimize) once their positions have been determined. However, this solution entails solving a system of linear equations, which substantially increases the number of computations required to determine the excitation signal and makes solution rather impractical.

SUMMARY OF THE INVENTION

It is the object of the present invention to counter the loss of signal-to-noise ratio in a synthetic speech signal associated with the successive approximation method of determining the excitation pulses for the filter producing the synthetic speech signal, without significantly increasing the number of necessary computations.

Accordingly, the invention provides a low-bit-rate speech encoding procedure which consists in substituting for the signal of the speech to be encoded parameters defining in successive time frames the characteristics of a filter modeling the vocal tract and defining positions and amplitudes of pulses which form the filter excitation signal and which are determined by successive approximation according to the criterion of minimization of the mean-squared error between the sample speech signal and the filter-produced synthetic speech signal. This procedure consists in adding to the amplitude of each pulse, after determining by successive approximation the positions and amplitude of the excitation signal, a correcting term based on the value of the partial derivative of the mean squared error in relation to the amplitude of the considered pulse taken as an independent variable.

This correction, although not optional, requires only a few additional computations.

BRIEF DESCRIPTION OF THE DRAWINGS

Other features and advantages of the invention will become apparent in reading the following description, made with reference to the accompanying drawings in which.

DETAILED DESCRIPTION OF THE INVENTION

Figure 1:
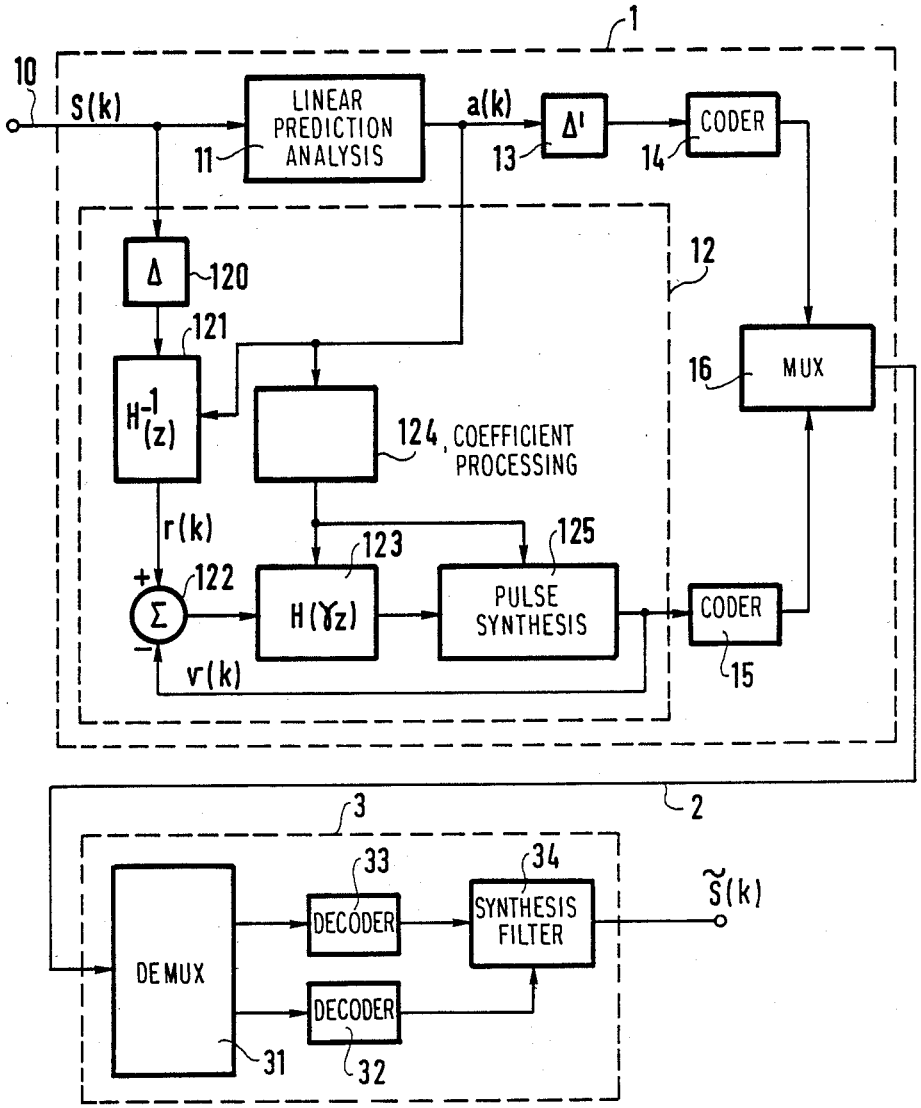
FIG. 1 is an overall block diagram of a vocoder utilizing linear prediction type digital coding.

As can be seen in FIG. 1, the vocoder consists of emitting means 1 connected via a low-bit-rate digital link 2 to receiving means 3. The emitting means 1 receives via an input 10, at a given sampling rate of for instance 8 kHz, digital samples S(k) of a signal of speech to be encoded, the frequency band whereof has previously been upwardly limited to half the sampling frequency. The emitting means groups these digital samples S(k) into successive blocks of N corresponding to time frames within which the characteristics of the vocal tract are assumed to be invariant, derives from each block a set of p coefficients a (k), called linear prediction coefficients, enabling definition during reception of the characteristics of a filter modeling the vocal tract and a multipulse signal v(k) intended to excite said filter in receiving mode, and formats the sets of linear prediction coefficients a(k) and the multipulse excitation signal v(k) for transmission over the low-bit-rate data link 2 to the receiving means 3. To this end said emitting or transmitting means comprises:

a linear prediction analysis circuit 11 which generates, based upon the digital samples S(k) of the speech signal to be encoded, the sets of linear prediction coefficients a(k) corresponding to the successive time frames, a multipulse excitation signal v(k) generating circuit 12 which operates on the digital samples S(k) of the speech signal to be encoded and the sets of linear prediction coefficients a(k) supplied by the analysis circuit for each block of N samples, a delay line 13 delaying each set of linear prediction coefficients a(k) supplied by the analysis circuit 11 for the amount of time required by the multipulse generating circuit 12 to generate the excitation signal corresponding to the same time frame and coders 14, 15 and a multiplexer 16 to format said sets of linear prediction coefficients a(k) and said multipulse excitation signal v(k) defined by the positions and amplitudes of its pulses, for transmission over the low-bit-rate digital data link 2.

Receiving means 3 comprises a demultiplexer 31 and two decoders 32, 33 connected in the input, which are adapted to the multiplexer 16 and coders 14, 15 of the transmitting means 1 and which extract from the signal received through the digital link 2 the sets of prediction coefficients a(k) and the multipulse excitation signal v(k), and a vocal tract modeling synthesis filter 34 whose characteristics are adjusted according to the linear prediction coefficient a(k) sets and which generates, based upon the multipulse excitation signal v(k), samples S~(k) of a synthesized speech signal reproducing the original speech signal.

The analysis circuit 11 of the emitting means 1 is a digital processing circuit familiar to persons skilled in the art and not part of the claims, and therefore not detailed in the figures. The way in which this circuit extracts the sets of prediction coefficients a(k) from the samples of the speech signal to be encoded is described in the book by J. Markel and A. Gray, entitled "Linear Prediction of Speech", Springer Verlag, Editor, New York, 1976. Briefly, the predicted signal $\hat{S}(n)$ is defined on the basis of previous values of the speech signal to be encoded S(n) by means of prediction coefficients a(k) according to the formula:

$$\hat{S}(n) = \sum_{k=1}^{p} a(k) \cdot S(n-k)$$

The prediction error or prediction residual r(n) is expressed by the relation r(n)=S(n)−S(n) which corresponds to the expression for the output signal from a predictive digital filter excited by the original speech signal having a transfer function whose z transform is defined on the basis of the prediction coefficients by:

$$H^{-1}(z) = -\sum_{k=o}^{p} a(k) \cdot z^{-k}, \text{ where } a(o) = -1$$

The prediction is considered optimal when the mean-squared error between the predicted values and the actual values define by $$F = \sum_{n} (S(n) - S(n))^2$$

is minimal. This is obtained by the least squares method which gives the linear prediction coefficients a(k) as solution to the set of equations $$\sum_{k=1}^{p} a(k) \cdot R(i-k) = R(i) \; i = 1, \ldots, p \qquad \text{(O)}$$

taking into account the correlation coefficients $$R(i-k) = \sum_{n} S(n-k) \cdot S(n-i) \text{ and } R(i) = \sum_{n} S(n) \cdot S(n-i)$$

which can be solved in several known ways, including the covariance method and the autocorrelation method described in the aforementioned work.

The transfer function of the synthesis filter 34 in the receiving means is H(z), expressed in terms of the prediction coefficients a(k) as:

$$H(z) = \frac{1}{-\sum_{k=o}^{p} a(k) \cdot z^{-k}}$$

It's synthesis is outside the scope of the present invention. It can be done using the prediction coefficients a(k) and applying the previous relation but is preferably realized by the Itakura-Saito method in the form of a trellis defined in terms of coefficients known as reflection coefficients, transmitted instead of the prediction coefficients a (k) with which they correspond by well known equivalence relations.

The multipulse excitation signal generator 12 produces for each time frame of the analysis of the signal to be coded a sequence of a minimal quantity of pulses with positions and amplitudes selected so as to obtain from the synthesis filter a synthetic speech signal reproducing as faithfully as possible for a listener the original speech signal.

The criterion used to evaluate the fidelity of reproduction of a speech signal by a synthetic signal is that of minimal mean-squared error, over an analysis time frame, between the original speech signal and the synthetic speech signal with an error weighting allowing for the perceptual properties that make a listener less sensitive to distortions occurring in the formant regions of the speech signal frequency spectrum of higher energy concentration. One known way of realizing this weighting, as taught in U.S. Pat. No. 4,133,976, consists in subjecting the error signal resulting from the difference between the original speech signal and the synthetic speech signal to filtering with a transfer function W(z) expressed in terms of that H(z) of the synthesis filter by the relation:

$$W(z) = \frac{H(\gamma z)}{H(z)} \quad 0 < \gamma < 1$$

This filtering can be obtained by routing the error signal or its components through a predictive filter having a transfer function $H^{-1}(z)$, then through a "perceptual" filter having a transfer function $H(\gamma z)$ which can be determined on the basis of the prediction coefficients, by the defining relation:

$$H(\gamma z) = \frac{1}{-\sum_{k=0}^{p} a(k) \cdot \gamma^k \cdot z^{-k}}$$

In general, the predictive filtering is carried out with respect to the error signal components, in an explicit way on the original signal and in implicit way on the synthetic speech signal, whereas the perceptual filtering is carried out on the error signal itself, once its components have been brought together after predictive filtering.

For the predictive filtering of the original speech signal the signal generating circuit 12 is provided with a delay circuit 120 which receives the blocks of N successive samples S(k) of the speech signal to be encoded corresponding to the successive time frames on which the analysis circuit 11 operates and which stores them for the time required by the analysis circuit to establish each set of prediction coefficients a(k), and a predictive filter 121 which receives its set of coefficients a(k) from the analysis circuitry 11 and the blocks of successive samples S(k) from the delay circuitry 120, and which supplies a prediction residual signal r(k).

The predictive filtering of the synthetic speech signal is obtained implicity by replacing said signal by the multipulse excitation signal v(k) from which it is derived through an H(z) filtering in the synthesis filter.

A subtractor 122 shapes the error signal by subtracting the multipulse signal v(k) from the prediction residual signal r(k) and applies it to a perceptual filter 123 receiving its coefficients from a processing circuit 124 that develops them using the set of prediction coefficients a(k) and implementing the last mentioned equation.

The pulse sequences forming the multipulse excitation signal for each of the time frames operated on by the analysis circuit 11 are generated in the generating circuit 12 by a pulse synthesizer circuit 125 which receives the weighted error signal from the perceptual filter 123. This pulse synthesizer circuit 125 generates for each sequence of the multipulse excitation signal a number of pulses compatible with the transmission capacity of the digital link 2 connecting the transmitting means 1 to the receiving means 3 whilst simultaneously assigning positions to them within the relevant time frame and amplitudes minimizing the energy of the weighted error.

Let A(i) be the amplitudes of these pulses, the quantity of which is assumed to be at most Q, and let m(i) be their respective positions, selected from among the discrete positions 1, . . . , N of samples scaled along the time frame. The sequence of pulses V(k) can be expressed as:

$$V(k) = \sum_{i=1}^{Q} A(i) \cdot d(k, m(i)),$$

where d(k,m (i)) is a function equal to one when k equals m(i) and equal to zero for all other values. Using h'(k) to denote the impulse response samples of the perceptual filter 123 having $H(\gamma z)$ as a transfer function, the weighted error e(k) is given by the expression:

$$e(k) = \sum_{n=-\infty}^{k} \left[ r(n) - \sum_{j=-\infty}^{0} B(j) \cdot d(n, b(j)) - \sum_{i=1}^{Q} A(i) \cdot d(n, m(i)) \right] \cdot h'(k-n) \quad (1)$$

where B(j) and b(j) define the pulses relating to the previous time frames.

The minimization of the energy of this weighted error over the time frame amounts to minimizing the quantity $$E = \sum_{k=1}^{N} e(k)^2$$

by a suitable choice of the pulse positions m(i) and their amplitudes A(i). This problem has no known optimal solution. However, a sub-optimal solution is known, in particular through U.S. Pat. No. 4,472,832, that consists in constructing the pulse sequence one pulse at a time. In effect, consider step (l), where l pulses have been placed in the sequence and where one wishes to place an (l+1)th pulse. The weighted error $e(k)^{(l+1)}$ at step (l+1) is expressed according to relation (1) as:

$$e(k)^{(l+1)} = \sum_{n=-\infty}^{k} \left[ r(n) - \sum_{j=-\infty}^{0} B(j) \cdot d(n,b(j)) - \sum_{i=1}^{l} A(i) \cdot d(n,m(i)) - A(l+1) \cdot d(n,m(l+1)) \right] \cdot h'(k-n)$$

or alternatively $$e(k)^{(l+1)} = e(k)^{(l)} - A(l+1) \cdot h'(k - m(l+1))$$

which makes it possible to define the energy E (l+1) of the weighted error in step (l+1) in relation to the energy of the weighted error E (l) in step (l) as:

$$E(l+1) = E(l) - 2 \cdot A(l+1) \cdot \sum_{n=1}^{N} e(n)^{(l)} \cdot h'(n - m(l+1)) + A^2(l+1) \cdot \sum_{n=1}^{N} h'(n - m(l+1))^2$$

and denoting by $t(k)^{(l)}$ the function $$t(k)^{(l)} = \sum_{n=1}^{N} e(n)^{(l)} \cdot h'(n-k) \quad (2)$$

and by C (i,j) the samples of the autocorrelation function of the perceptual filter's (123) impulse response $$C(i,j) = \sum_{n=1}^{N} h'(n-i) \cdot h'(n-j)$$

$$E(l+1) = E(l) - 2A(l+1) \cdot t^{(l)}(m(l+1)) + A^2(l+1) \cdot C(m(l+1), m(l+1)) \quad (3)$$

This expression finds its minimum when its derivative with respect to the amplitude A(l+1) of the (l+1)th pulse becomes equal to 0, i.e., for the value:

$$A(l+1) = \frac{t^{(l)}(m(l+1))}{C(m(l+1), m(l+1))} \quad (4)$$

and thus assumes the value:

$$E(l+1)\min = E(l) - \frac{t^{(l)}(m(l+1))^2}{C(m(l+1), m(l+1))} \quad (5)$$

It becomes apparent that in order to reduce the energy of the weighted error as fast as possible in a method where the pulse sequences are constructed by successive approximations, pulse by pulse, it is necessary to choose each time the pulse position which maximizes the ratio of the square of the t(k) function over the C(k,k) function and to adopt as the amplitude for said pulse the value defined by relation (4).

The implementation of this approach to generating the multipulse excitation signal by successive approximation of the pulse sequences is carried out according to a procedure well known to those skilled in the art, as taught by the aforementioned U.S. Pat. No. 4,472,832 in particular, with the help of correlation-type digital signal processing circuits connected into the pulse synthesis circuit 125 which compute the numerator cross-correlation and denominator autocorrelation functions of the right hand member of equation (4) from the samples of the weighted error supplied by the perceptual filter 123 and from the samples of the perceptual filter's impulse response supplied by the processing circuit 124.

This rather elaborate method of producing the excitation signal has the disadvantage of accumulating the errors in its various stages.

To correct this fault, it has been proposed to recalculate the amplitudes of all the pulses in a multipulse excitation signal sequence after all the pulse positions have been selected by the previous method.

In fact, deriving the weighted error e(k) given by relation (1) with respect to the amplitudes of pulses A(i) placed in selected temporal positions m(1), . . . , m(Q) of the given time frame, yields:

$$\frac{\partial e(k)}{\partial A(i)} = -h'(k - m(i))$$

wherefrom it is possible to deduce the derivative of the mean-squared error over one time frame which must be reduced to zero to give the optimal pulse amplitudes:

$$\frac{\partial E}{\partial A(i)} = 2 \cdot \sum_{k=1}^{N} e(k) \cdot \frac{\partial e(k)}{\partial A(i)} = -2 \sum_{k=1}^{N} e(k) \cdot h'(k - m(i)) \quad (6)$$

which leads, by expliciting e(k) using relation (1) and the writing convention of relation (3), to the linear system:

$$\sum_{i=1}^{Q} A\,\mathrm{opt}(i) \cdot C(m(i), m(j)) = T(j), j = 1, \ldots, Q \quad (7)$$

the T(j)'s being samples of the cross-correlation function between the weighted error when no pulse has been positioned in the time frame and the impulse response of the perceptual filter:

$$T(j) = \sum_{n=1}^{N} \left\{ \sum_{k=-\infty}^{n} \left[ r(k) - \sum_{i=-\infty}^{o} B(i) \cdot d(k, b(i)) \right] \cdot h'(n-k) \right\} \cdot h'(n - m(j)) \quad (8)$$

This linear system is solvable but entails a heavy computation load which is hardly compatible with the requirement to generate each sequence of pulses of the multipulse excitation signal in a shorter time than the duration of the successive time frames of the order of 10 to 20 ms adopted by the analysis circuit for the determination of the prediction coefficients a(k).

To combat the lack of precision concerning the amplitudes of the pulses in a sequence of the multipulse excitation signal due to the successive approximation method used to determine them, it is proposed in accordance with the invention to end the determination of the pulses in a sequence with an updating of their amplitudes by means of a corrective term which is equal for each of the pulses to the amplitude that would be given to an additional pulse if the successive approximation procedure were extended for one more step, and arbitrarily setting the position of the new pulse to the same location.

In this way, having determined the maximum number Q of pulses expected to be provided in the course of Q successive steps, disposed in m(1), . . . ,m(Q) positions, we correct the amplitude A(i) of each of the pulses with the help of the corrective term A'(i) obtained from relation (4) as follows:

$$A'(i) = \frac{t^{(Q)}(m(i))}{C(m(i), m(i))} \quad (9)$$

which corrective term can further take the form, based on relations (2) and (6):

$$A'(i) = -\frac{1}{2} \cdot \frac{\frac{E}{A(i)}}{C(m(i), m(i))} \quad (10)$$

and which may be defined as the ratio of two terms with the partial derivative, with respect to the amplitude A(i), of the weighted squared error between the original speech signal and the synthetic speech signal in the numerator, and the zero value of the autocorrelation function of the perceptual filter impulse response delayed by an amount of time corresponding to the position of the pulse under consideration in relation to the start of the time frame, in the denominator.

The worth of this correction is apparent by comparing with the method involving the overall recalculation of the optimal amplitudes of all the pulses, described previously herein, which gives the optimal values A opt (i) as the solution to the system of equations:

$$\sum_{i=1}^{Q} A\,opt\,(i)\,C\,(m(i),\,m(j)) = T\,(j)\;j = 1, \ldots, Q \tag{11}$$

Note that the term T(j) can be expressed:

$$T\,(j) = \sum_{k=1}^{N} e\,(k) \cdot h'(k - m(j)) + \sum_{i=1}^{Q} A(i) \cdot C\,(m(i),m(j))$$

The above system of equations (10) can be rewritten as $$\sum_{i=1}^{Q} [A\,opt\,(i) - A(i)] \cdot C(m(i),m(j)) = \sum_{k=1}^{N} e\,(k) \cdot h'(k - m(j))\;j = 1, \ldots, Q$$

or alternatively, using correction terms A''(i), as $$\sum_{i=1}^{Q} A''(i) \cdot C\,(m(i),m(j)) = \sum_{k=1}^{N} e\,(k) \cdot h'\,(k - m(j)) \tag{12}$$

By comparing this system of equations with relations (2) and (9) it can be seen that the corrective term A'(i) can be defined on the basis of the definition of corrective term A''(i) given by the optimal solution, assuming that the values C(i,j) of the correlation between two impulse responses of the perceptual filter are null when they are not simultaneous. This is a reasonable approximation since, given the considerable damping of the envelope of the perceptual filter's impulse response, C(i,j) quickly becomes much smaller than C(i,i) when i and j are spaced a few samples apart, and consequently the correction A''(i) given for the optimal solution is chiefly due to the term C(i,i). Thus, the approximation of the optimal corrective term A''(i) by the corrective term A'(i) enables correction of the largest aberrations affecting the pulse amplitudes at the time of their determination by successive approximation.

The corrective term A'(i) presents the added advantage of having a defining relation similar to that (4) of the amplitude A(l+1) of the pulse placed during each step of the approximation method and accordingly of being able to be generated with a very limited number of additional operations having nothing in common with the computational requirement for the solution of the system of equations (12).

The step of generating the set of Q corrective terms A'(i) takes place after the Qth step of the approximation method, the step wherein the Qth pulse has been determined by means of the working out of the function $t_{(k)}^{(Q-1)}$. It is similar, as will be explained hereinafter, to an added step of the approximation method wherein, instead of computing the function $t_{(k)}^{(Q)}$, a systematic computation is made of the pulse amplitudes of all the previously determined pulse positions.

Figure 2:
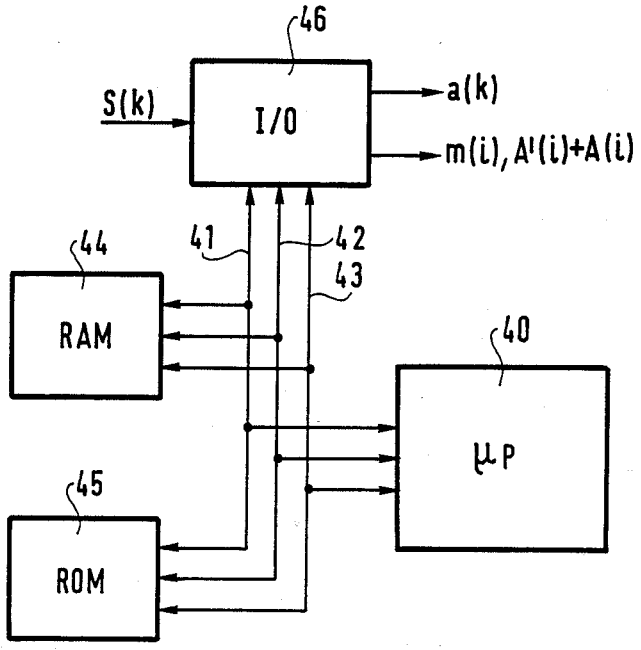
FIG. 2 is a diagram of a preferred embodiment of a linear prediction analysis circuit and a signal generating circuit for generating a multipulse signal, used in the vocoder diagrammed in FIG. 1.

FIG. 2 ilustrates an embodiment of the analysis circuit 11 and the pulse generating circuit 12 of the transmitting means.

The transmitter consists of a microprocessor 40 connected via address, data and control buses, 41, 42 and 43 respectively, to a read and write memory (RAM) 44 used to temporarily store the samples of the speech signal to be encoded S(k) along with computation variables, to a read-only memory (ROM) 45 containing programs for forming into blocks the samples S(k) of the speech signal to be encoded, for computing the set of prediction coefficients a(k) corresponding to each block and the samples h'(k) of the perceptual filter's impulse response, as well as for determining the positions and amplitudes of the pulses of the multipulse excitation signal sequence, and to an input/output interface 46 enabling input of the digital samples S(k) of speech to be encoded and output to the coders of the sets of prediction coefficients a(k) and the positions and amplitudes of the multipulse excitation signal sequences.

The microprocessor 40 carries out several operations simultaneously under the control of the programs stored in the ROM 45.

Firstly, it arranges into N-sized blocks the samples of the original speech signal to be encoded S(k) which stream in steadily in serial form, interrupting its other tasks every 125 μs for a sampling rate of 8 kHz to collect them from its input and store them in the RAM 44.

Having completed one block of samples, the microprocessor computes the set of prediction coefficients a(k) for the block by solving the system of equations (o) according to one of the known methods described in the aforementioned technical work, and stores these in the RAM 44.

Based on this set of coefficients a(k), it generates the samples h'(k) of the perceptual filter's impulse response as well as the samples of the prediction residual signal r(k) and the autocorrelation signals C(i,i) of the perceptual filter's impulse response, which it stores in RAM. It then develops the sequence of the multipulse excitation signal.

To generate the multipulse excitation signal sequence, the microprocessor proceeds, as previously indicated, according to a successive approximation method with Q steps, computing at each step a function $$t^{(l)}(k) = \sum_{n=1}^{N} e^{(l)}(n) \cdot h'\,(n - k)\;k = 1, \ldots, N$$

by updating from the previous step with the help of the recurrence formula $$t^{(l)}(k) = t^{(l-1)}(k) - A(l) \cdot C\,(k,m(l))$$

which takes into account the fact that the weighted error in any step of the successive approximation is expressed in terms of the weighted error in the preceeding step, by the relation $$e^{(l)}(k) = e^{(l-1)}(k) - A\,(l) \cdot h'\,(k - m(l))$$

expressing the accounting of the new pulse.

The microprocessor thereafter stores in RAM the values of this function $t_{(k)}^{(1)}$ and then computes the function $z_{(k)}^{(1)}$ using the formula $$z^{(l)}(k) = \frac{(t^{(l)}(k))^2}{C(k,k)},$$

determines the value of k for which this function is maximal and takes this as the value for the marker m(l+1) marking the position of the (l+1)th pulse, the amplitude A(l+1) wherof it determines by solving the equation:

$$A(l+1) = \frac{t^{(l)}(m(l+1))}{C(m(l+1),m(l+1))}$$

During the first step, the function t(o)(k) is computed on the basis of its definition by means of the samples r(k) of the prediction residual signal, allowing for the fact that the sequence of the multipulse signal over the current time frame at that time is a null signal:

$$\sum_{n=1}^{N}\left\{\sum_{i=-\infty}^{n}\left[r(i) - \sum_{j=-\infty}^{o} B(j)\cdot d(i,b(j))\right]\cdot h'(n-i)\right\}\cdot h'(n-m(k))$$

After the last step of the successive approximation procedure having served to determine the position m(Q) and the amplitude A(Q) of the Q-th pulse by means of the last update $$t^{(Q-1)}(k) \quad k = 1, \ldots, N$$

of the set of values of the functiont, the microprocessor determines the corrective terms for the amplitudes of all the pulses by a final updating of the set of values of the function t(k) limited to the markers m(i):

$$t^{(Q)}(m(i)) \; i = 1, \ldots, Q$$

and by computing the whole set of values for the corrective terms $$A'(i) = \frac{t^{(Q)}(m(i))}{C(m(i), m(i))} \quad i = 1, \ldots, Q$$

which computation is of the same type as those carried out previously to determine the amplitudes A(l) of each pulse.

Lastly, it makes the corrections by adopting as the final amplitudes for the pulses in the given time frame the values: A(i)+A'(i) i=1, . . . , Q which it may be noted match the amplitudes B(−s.Q+i) in Relation (1) for the determination of the pulses in the s-th time frame following.

The step of developing the corrective terms, since it does not require any operations differing substantially from those performed in the course of any successive approximation step, is easily integrated with the latter without significantly lengthening its implementation time. This is a fundamental advantage in the context of vocoder processing where the generation of each sequence of the multipulse excitation signal must take place within the limited time of an analysis time frame.

What is claimed is:

1. A low-bit-rate encoding method of the type comprising the steps of receiving an input signal representing speech to be encoded, generating in response to said input signal a plurality of parameters defining, for successive time frames, the characteristics of a synthesis filter modeling the vocal tract, generating a multipulse excitation signal for said filter comprising a plurality of pulses having positions and amplitudes determined by successive approximation according to the criterion of the minimization of the means squared error between the original speech signal to be encoded and a synthetic speech signal to be produced by said filter, said method further comprising, after determining the positions and amplitudes of said pulses by successive approximation, the further step of adding to the amplitude of each pulse a correcting term based on the value of the partial derivative of the mean squared errror with respect to the amplitude of said each pulse taken as an independent variable, said method further comprising weighting said mean squared error by filtering in a perceptual filter whose impulse response is defined relative to that of said synthesis filter, wherein the corrective term added to the amplitude of each of the pulses determined by successive approximation is proportional to the partial derivative of the weighted mean squared error carried out with respect to the amplitude of the pulse under consideration taken as an independent variable and divided by the value for zero of the autocorrelation function of the impulse response of the perceptual filter delayed by an amount of time corresponding to the position of the pulse under consideration in relation to the start of the time frame.

* * * * *